United States Patent [19]

Achàrd

[11] 4,437,089

[45] Mar. 13, 1984

[54] DUAL SENSITIVITY INTRUSION DETECTION SYSTEM

[75] Inventor: Serge Achàrd, Marly-Le-Roi, France

[73] Assignee: S.A. Promocab, Versailles, France

[21] Appl. No.: 276,498

[22] Filed: Jun. 23, 1981

[30] Foreign Application Priority Data

Jun. 24, 1980 [FR] France ..... 80 13982

[51] Int. Cl.[3] ..... G08B 13/22; G08B 29/00

[52] U.S. Cl. ..... 340/541; 340/501; 340/522; 340/587

[58] Field of Search ..... 340/541, 522, 521, 587, 340/554, 555, 501

[56] References Cited

U.S. PATENT DOCUMENTS

| | | | |
|---|---|---|---|
| 3,074,053 | 1/1963 | McDonough . | |
| 3,967,283 | 6/1976 | Clark et al. | 340/554 |
| 4,021,796 | 5/1977 | Fawcett, Jr. et al. | 340/501 |
| 4,092,643 | 5/1978 | Stolarczyk | 340/541 |
| 4,142,187 | 2/1979 | Nakayama | 340/554 |

FOREIGN PATENT DOCUMENTS 2021893 4/1979 United Kingdom .

OTHER PUBLICATIONS

Proceedings 1976 Carnahan Conference on Crime Countermeasures, May 1976, "Progressive Entry Detection System", pp. 89–92.

English translation entitled "Safety with Stotz Burglar Alarm Systems" by Helmut Beigel, of German publication entitled Sicherheit mit Stotz-Alarm Einbruchmeldeanlagen BBC-NACHRICHT No. 12, 1978, pp. 534–539.

*Primary Examiner*—Glen R. Swann, III

*Attorney, Agent, or Firm*—Lyon & Lyon

[57] ABSTRACT

At least two circuits of sensors for detection of human presence are arranged in a protected zone and are capable of producing electric signals when they detect a human presence. In a preferred embodiment, when a human presence is detected by a first sensor circuit, the sensitivity of the sensors of the second sensor circuit is increased.

10 Claims, 3 Drawing Figures

1
2
51a
INTERFACE
TELE-COM. MEANS
7
CONTROL MODULE
REACTION MEANS
4
INTERFACE
51b
INTERFACE
53
REACTION MEANS
5
52
50
6
COMPARISON MODULE
3
REACTION MEANS
51c
INTERFACE
DIALOG MEANS
51d
INTERFACE
55
AUTORIZATION HOUSING
56
56
56

DUAL SENSITIVITY INTRUSION DETECTION SYSTEM

BACKGROUND OF THE INVENTION

The object of the present invention is the protection of a zone against human aggression.

Such a system must function in the following three basic situations. The system must first of all detect intruders as soon as they penetrate the zone under surveillance. It must in addition slow the movement of such intruders so as to render more difficult access to their objectives. Finally, it should possibly reject or neutralize the aggressors by various means dependent upon the circumstances and types of aggression.

These systems must moreover be efficient in all possible applications, that is, they must be able to provide both external peripheral protection, close-in interior protection (in a particularly sensitive zone), internal surveillance of locales, being able to distinguish between free circulation sectors, controlled access sectors and mixed, external and internal, surveillance.

Such a system should also provide for the possible use of telecommunications assemblies able to transmit alarm information at a distance.

Finally, these systems must be sufficiently flexible to adapt to a large variety of locations of all types, whether large units such as an air base or a refinery or isolated small-sized locations such as microwave relay stations.

SUMMARY OF THE INVENTION

To this end, the object of the present invention is a system for the protection of a zone against human aggression, which comprises at least two circuits of sensors for detection of human presence arranged within this zone, which can produce electric signals when they detect human presence, reaction means with respect to an aggressor and electronic processing means arranged between the sensors for the detection of human presence and the reaction means, able to operate the reaction means when they receive a signal emitted by a detection sensor.

In a preferred embodiment of the invention, the processing means comprise means for increasing the sensitivity of the sensors of a second sensor circuit at the time of reception of a signal from a sensor of a first sensor circuit.

Preferably the sensors of at least one sensor circuit are of the all-or-nothing type whereas the sensors of at least one other circuit are of the cumulative type.

Finally, telecommunications means controlled by said electronic processing means are preferably provided.

The association of several circuits for the detection of human presence allows for the analysis of several parameters which confers a certain number of advantages to the system.

Firstly, in this manner internal checking of the effects detected is ensured, which eliminates false alarms. Moreover, if the second sensor circuit comrises sensors of the redundant type, it is possible to program the response of the system from information collected by this second sensor circuit. Finally, the independence of the response of the system from the effects of the environment can in this manner be ensured at will.

The invention therefore provides the person in charge of the surveillance of the controlled zone with an indication of the simultaneous state of the various points which may be crossed over by non-authorized persons. Breakdown into zones can of course be effected with zones as small as desired.

It is moreover simple to operate the response elements of different types with regard to the function of slowing down intruders. Thus, lighting systems, sound systems or sirens may be used, dependent upon the type of size and length of the alarms. The function of rejection or neutralization of aggressors can also be programmed, the response means thus being selected in accordance with their efficacy. These response means can for example be rejection means, such as a variable controlled-frequency energy transmitter able to exert intense physiological reaction which cause the presence of an aggressor to become unbearable to him within the environment of said means. These response means can also be more response traditional consisting of a lighting gradation or of personalized messages recorded on, for example, magnetic tapes. Finally, in very high risk zones, means for so-called physical neutralization may be used.

The sensors for the detection of human presence can also be of several types. They can in particular be based either on detection of energies specific to a particular individual (such as pressures, vibrations, punctual variations of temperature, etc.) or on the modification of energy propagation conditions of various types (infrared, hyperfrequency, Hertzian waves, etc.).

Preferably, the central unit comprises means capable of comparing the signals received from the sensors with typical signals retained in a memory.

In one embodiment of the invention, the central unit is comprised of means capable of operating the response means according to fixed programs. The response means can also be operated in a variable manner.

The central unit is preferably arranged so as to enable the functional modification of certain elements of the system in the case of a functional anomaly of one of its components.

Finally, the response means are also preferably individually programmed.

BRIEF DESCRIPTION OF THE DRAWINGS

One embodiment of the invention will now be described as a non-limiting example, by reference to the attached schematic drawings, in which.

DESCRIPTION OF THE PREFERRED EMBODIMENT

Figure 1:
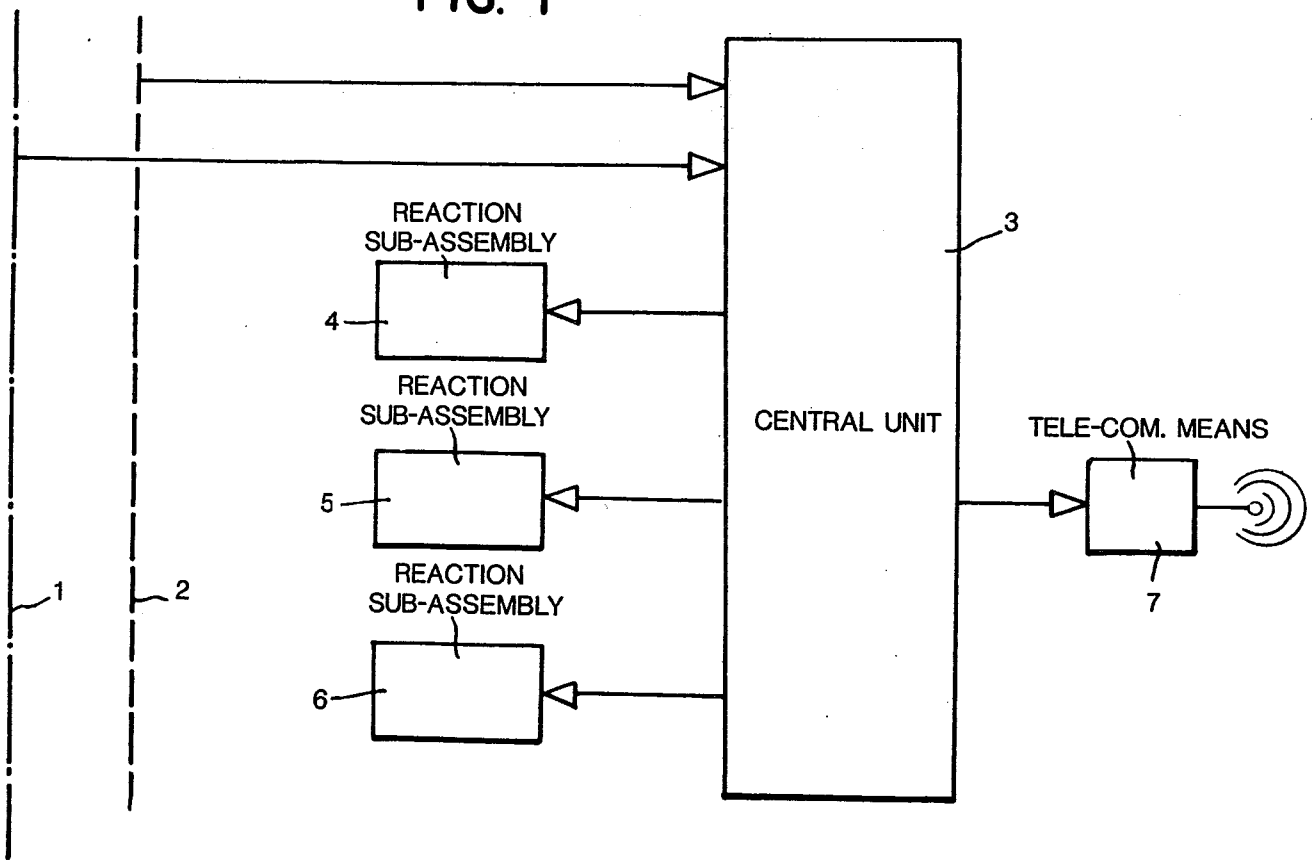
FIG. 1 is an overall diagram of a system according to the invention.

FIG. 1 represents a system for protection against human aggression in accordance with the invention.

This system firstly comprises two circuits 1 and 2 of sensors for the detection of human presence. A central unit 3 for electronic processing receives electric signals emitted by the sensors of the sensor circuits 1 and 2 and, in function with these signals, operate control signals directed towards the response sub-assemblies 4, 5 and 6.

Telecommunications means 7 are provided so as to direct the alarm signals from a distance when they are activated by the control signals from the central unit 3.

The following is a schematic example of the operation of this system:

Crossing the first circuit 1 of sensors for the detection of human presence causes a pre-alarm which can, for example on the one hand, automatically set off a lighting system in the zone under surveillance and on the other hand immediately increase for an indeterminate length of time the sensitivity of the sensors of the second circuit of sensors.

This increase in the sensitivity of the sensors of the second circuit can be produced in two ways. It can firstly be produced in an analogical manner, that is, by regulating the reaction threshold of the sensors of the second circuit, that is by further increasing their amplification. It can also be produced in a temporal manner when the sensors are of the redundant type. In this case, the sensitivity is increased by taking into consideration an ever-decreasing number of impulses supplied by these sensors before setting off the alarm.

When aggressors effectively penetrate the controlled zone, that is when they cross the second circuit of sensors, they cause immediate excitation of these sensors which can, for example, have the effect of setting off, from the time of the first impulse, a second pre-alarm, which automatically sets off a sub-assembly of reactions such as 4, 5 or 6, for example a sound system, and, from the time of the following impulses, effectively sets off alarms, causing all the other reaction means to enter into service.

Figure 2:
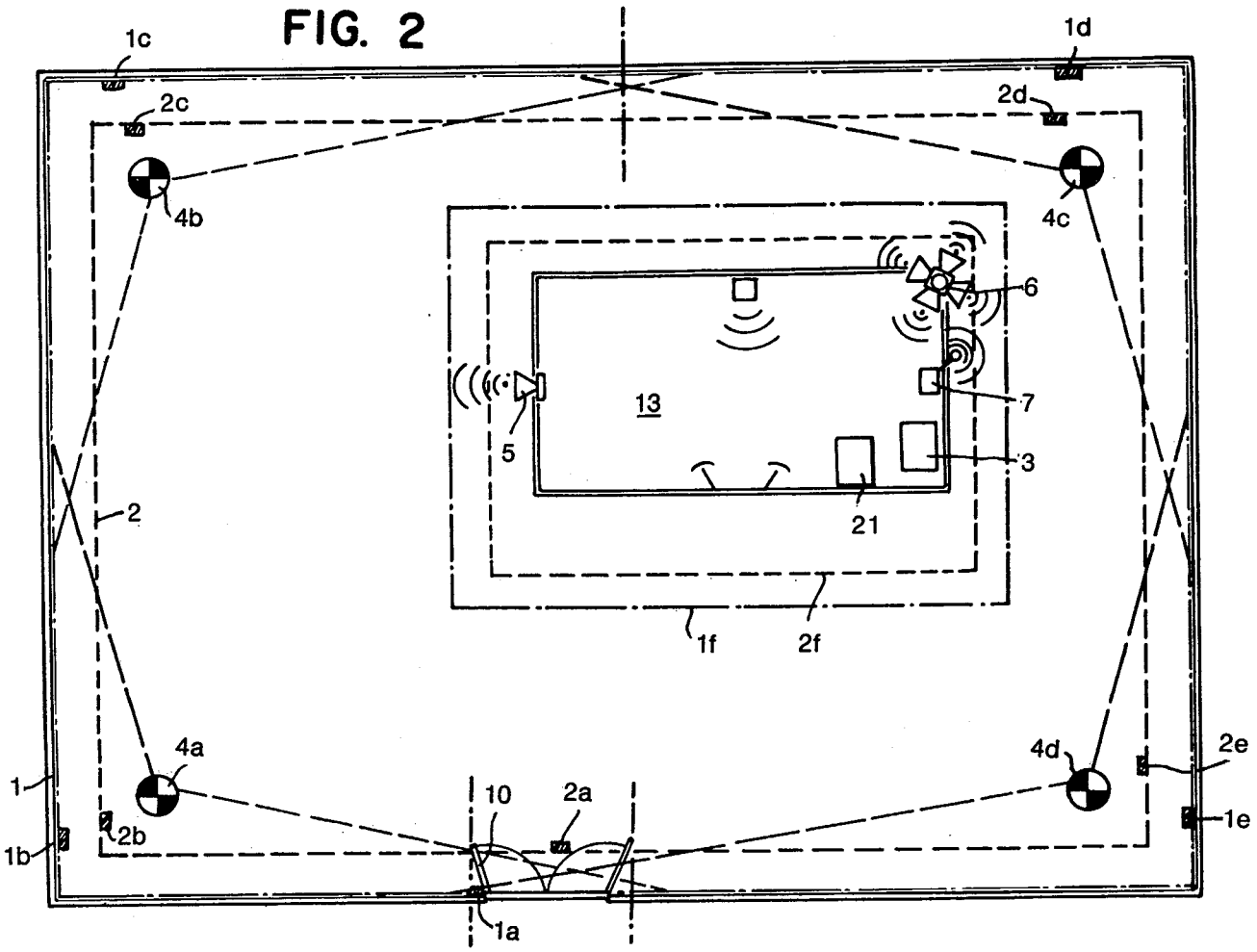
FIG. 2 is an illustration showing the possible physical arrangement of a system such as that shown in FIG. 1.

FIG. 2 is a schematic representation of an embodiment of the sub-assemblies of a device as shown in FIG. 1.

A first circuit of sensors 1 formed, for example, by sensors 1*a*, 1*b* to 1*e* and 1*f*, which are distributed in the present case in six zones. These sensors detect a first parameter and emit electrical signals which are directed to a central unit which is described below.

Sensors 1*a* to 1*f* are of the all-or-nothing type.

Sensor 1*a* is for example a contact provided on door 10. On the other hand, sensors 1*b* to 1*f* are, for example, guided wave detectors or even live wires on fencing.

A second circuit of sensors 2 is also connected to the central unit. This circuit of sensors is formed by zones 2*a* to 2*e* arranged respectively in proximity to sensors 1 to 1*e* and of a sensor 2*f* arranged in proximity to sensor 1*f*. Each of these zones can, in certain embodiments, be divided into several sub-zones.

The sensors of this second circuit of sensors are, for example, of the cumulative type, that is, each detected movement of an individual causes a succession of information. These sensors can for example be buried seismic sensors, or hyperfrequency barriers with adjustable amplification control.

It will be noted that sensors 1*f* and 2*f* are, in the example shown, intended for close-in protection of a site 13, whereas sensors 1*a* to 1*e* and 10*a* to 10 are intended for its more distant protection.

A central processing unit 3 receives on the input terminals of its numerical interface the signals being emitted by the sensors of the first circuit 1 (all-or-nothing input) and on the input terminals of its analogical interface, the output signals of the sensors of the second circuit 2.

The central unit 3 is produced in a conventional manner in order to effect all the operations of propgram processing, of auto-surveillance and of decision-taking. In addition it controls the display units 21 arranged in a guard-post.

The central unit 3 also sets off the response means when it receives signals coming from the sensors.

The central unit is moreover arranged so as to allow for functional modification of certain elements of the system in the case of a malfunction of one of its components. Thus, for example, the sensitivity of the second circuit of sensors can be increased when malfunctioning of the first circuit of sensors is detected.

In the example shown, these reactions means are composed of lights 4*a* to 4*d*, a sound system 5 comprising, for example, a loudspeaker connected to a tape recorder on which a message intended for the aggressors is recorded, and an assembly of sirens 6.

The reaction means 4 to 6 are set off by pre-alarm or alarm states of the central unit, which will be described below, in accordance with programs which may be fixed, that is integrated with the central unit, or may vary as a function of the size and form of the aggressions.

The various response means used can be programmed individually with respect to energy level, length of presence or recurrence of controls.

Finally, telecommunications means 7 are also controlled by the central unit 3 and enable transmission of all desirable data from a distance. They also offer the possibility of a modification of the response programs from a central body simultaneously supervising several systems of this type placed under its control.

Figure 3:
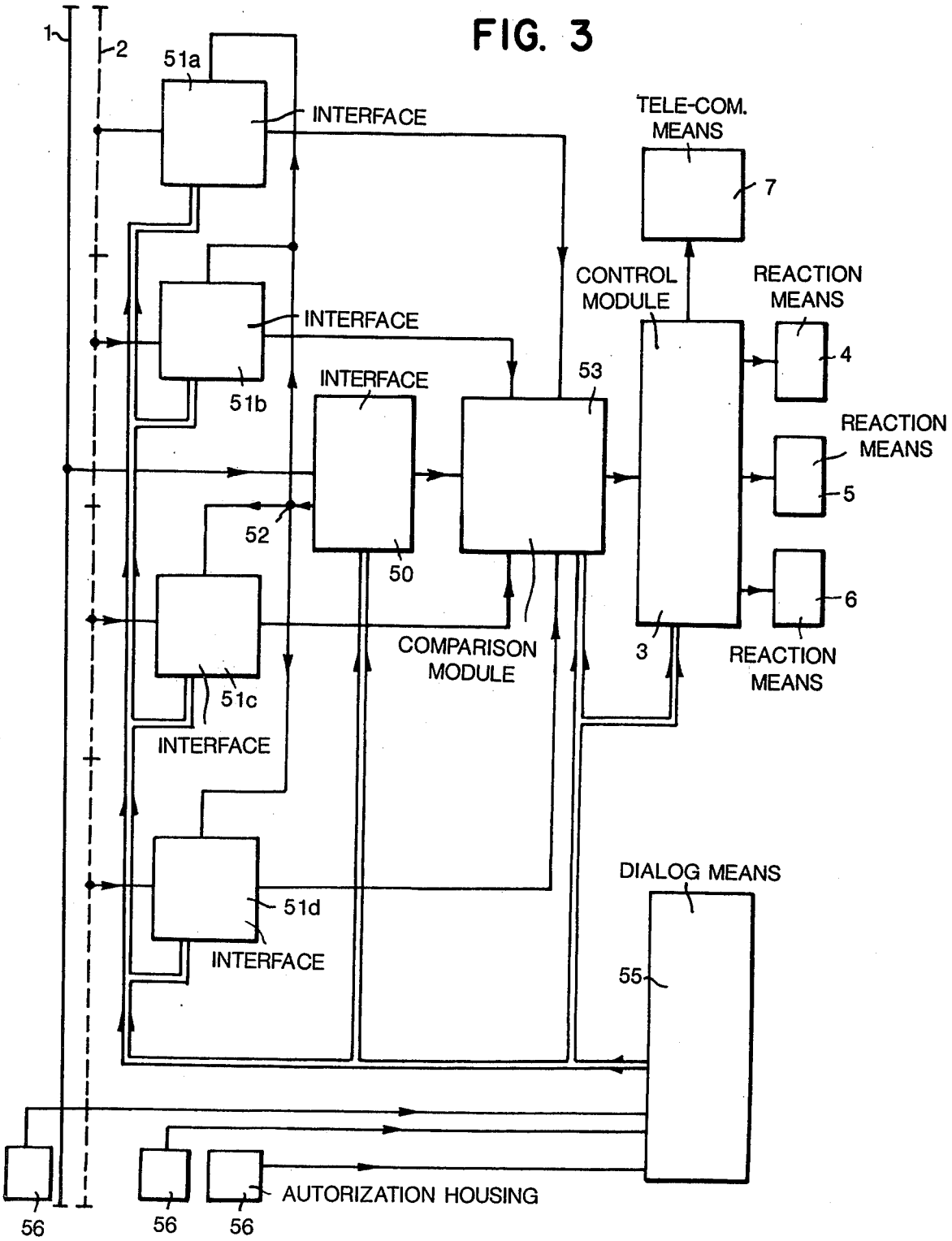
FIG. 3 is a more detailed diagram of the system of FIG. 2.

The operation of the installation of FIG. 2 will now be described by reference to FIG. 3.

The all-or-nothing type sensors of the first circuit of sensors 1 have their output connected to a signal processing interface 50 wherein they are compared to the typical sensor response in case of alarm.

The sensors of the second circuit 2 of sensors are connected to interfaces 51*a* to 51*d*. Interface 50 has an output 52 connected at input points provided for this purpose in interfaces 51*a* to 51*d* to permit activation or an over-sensitization of the sensors of the second circuit of sensors in the case of prior excitation of sensors of the first circuit.

The signals from the various interfaces are then sent to a comparison module 53 in which they are analyzed and compared to typical signals which are retained in memory with a view to transmitting or not transmitting alarm signals to the control module 3.

This control module, which constitutes the so-called central unit, controls the assembly of reaction means, for example means 4, 5 and 6 of FIG. 2.

An output from the control module 3 is directed towards the telecommunications means 7.

Finally a sub-assembly 55 operates, in a known manner, all the dialog signals between the various modules, such as return to zero, memory start-up, time adjustment, selection, manual or automatic test, operation check, etc . . . ).

The sub-assembly 55 also provides for the processing of signals from housings 56, whose control by a key, a magnetic card or by any other reading means, according to a pre-programmed process, enables the entry or exit of authorized personnel by appropriate masking of the alarms.

When an aggressor is detected by a sensor of circuit 1 a signal is transmitted to interface 50, which emits, through output 52, a signal providing for the lowering of the sensitivity threshold of the sensors of the second circuit, and which simultaneously emits a signal to the comparison module 53, placing the system in a state of pre-alarm.

If a sensor of the second circuit of sensors 2 is then excited, one of the interfaces 51*a* to 51*d* transmits a signal to the comparison module 53 which, already in a state of pre-alarm, emits a signal to the control module 3, which, in accordance with the program selected, activates the telecommunications means 7 and the reaction means 4, 5 and 6.

Of course certain of the reaction means can be set off solely in the pre-alarm state. In this manner, in the example shown, the lighting systems 4 can be activated as soon as an aggressor is detected by a sensor of circuit 1, whereas the sound means 5 and the sirens 6 will only be set off when the aggressor has crossed the second circuit of sensors 2.

Of course various modifications can be made to the embodiments described above without departing from the framework of the invention.

I claim:

1. A system for protecting a zone against human aggression, comprising at least two circuits of sensors for detection of human presence, said sensor circuits arranged within said zone and capable of producing electric signals when they detect a human presence, response means activated by said electric signals for indicating human presence, electronic processing means arranged between the sensors for detection of human presence and the response means, to operate first response means when they receive an electrical signal from a detection sensor of a first circuit of sensors and second response means when they receive an electrical signal from a detection sensor of a second circuit of sensors, said electronic processing means comprising means to increase the sensitivity of the sensors of the second circuit of sensors at the time of reception of a signal from a sensor of the first circuit of sensors.

2. The system according to claim 1, wherein the sensors of said first circuit of sensors are of the all-or-nothing type.

3. The system according to any one of claims 1 or 2, wherein the sensors of said second circuit of sensors are of the cumulative type.

4. The system according to claim 1, which further comprises telecommunications means controlled by said electronic processing means.

5. The system according to claim 1, wherein the electronic processing means comprises means capable of comparing the signals received from the sensors with typical signals retained in memory.

6. The system according to claim 1, wherein the electronic processing means comprises means capable of operating the response means in accordance with fixed programs.

7. The system according to claim 1, wherein the electronic processing means comprises means capable of operating the response means in a variable manner.

8. The system according to claim 1, wherein the electronic processing means is arranged to enable the functional modification of certain components of the system in the case of an anomaly in the function of one of its components.

9. The system according to claim 1, wherein the electronic processing means comprises means capable of operating the response means independently of each other.

10. The system according to claim 1, wherein the first response means activated by the sensors of the first circuit of sensors are arranged to provide a pre-alarm.

* * * * *